United States Patent [19]

Winter et al.

[11] Patent Number: 4,844,360

[45] Date of Patent: Jul. 4, 1989

[54] LONG-LENGTH CONTINUOUS METAL STRIP FEED DEVICE

[75] Inventors: Joseph Winter, New Haven; Warren F. Smith, Jr., Branford, both of Conn.

[73] Assignee: Olin Corporation, New Haven, Conn.

[21] Appl. No.: 220,335

[22] Filed: Jul. 12, 1988

Related U.S. Application Data

[63] Continuation of Ser. No. 32,805, Apr. 1, 1987, abandoned.

[51] Int. Cl.[4] ..... B65H 16/00

[52] U.S. Cl. ..... 242/55; 211/171; 242/78.6

[58] Field of Search ..... 242/78.6, 68.3, 55.42, 242/55, 105, 80, 130.2; 211/166, 171, 172, 173, 174

[56] References Cited

U.S. PATENT DOCUMENTS

| | | | |
|---|---|---|---|
| 187,271 | 2/1877 | Haight | 242/80 |
| 612,718 | 10/1898 | Finan | 211/171 |
| 736,603 | 8/1903 | Kester | 211/166 |
| 929,324 | 7/1909 | Panzer | 242/55.42 |
| 2,978,155 | 4/1961 | Knutson | 242/55.42 X |
| 3,089,588 | 5/1963 | Correll . | |
| 3,106,013 | 10/1963 | Rozmus . | |
| 3,338,498 | 8/1967 | Nelson . | |
| 3,379,386 | 4/1968 | Bobotts et al. . | |
| 3,575,357 | 4/1971 | Manner | 242/105 |
| 3,584,809 | 6/1971 | Ogden | 242/105 |
| 3,847,323 | 11/1974 | Good et al. . | |
| 3,889,891 | 6/1975 | Walker | 242/55 |
| 4,022,396 | 5/1977 | Manchester et al. . | |

FOREIGN PATENT DOCUMENTS 43-13509 6/1967 Japan .

OTHER PUBLICATIONS

"New System Provides Continuous Coil Without Accumulators", *Fabricator*, May/Jun. 1986.

*Primary Examiner*—Stuart S. Levy
*Assistant Examiner*—Katherine Matecki
*Attorney, Agent, or Firm*—Gregory S. Rosenblatt; Paul Weinstein

[57] ABSTRACT

The present invention relates to a device for supplying extra-long lengths of continuous metal strip material to metal processing and/or manufacturing equipment. The device has a central member adapted to receive a plurality of coils of strip material and free to rotate about its longitudinal axis and a plurality of retractable spacing elements for separating adjacent coils of material without interfering with the material feed operation. To insure a supply of material sufficient to enable operation of the equipment for long periods of time, the coils stacked on the central member are interconnected.

11 Claims, 1 Drawing Sheet

LONG-LENGTH CONTINUOUS METAL STRIP FEED DEVICE

This is a continuation of co-pending application Ser. No. 32,805 filed on Apr. 1, 1987, now abandoned.

The present invention relates to a device for supplying extra-long lengths of continuous metal strip material to processing and/or manufacturing equipment.

Commercial strip materials are usually slit from wide coils of cold rolled metal. The slit materials are taken up on a rotating shaft as continuous, relatively thin, flat coils known as flat packs. These flat packs are then stacked and shipped upon a pallet to metal processors and fabricators. The length of each coil is usually limited by original ingot weight in pounds per inch width, handling problems and/or safe shipping restrictions. For example, the size of most coils is in part limited because they are wound vertically but shipped horizontally. If a coil is too large, it could telescope which in turn could cause it to go scrap.

Some metal manufacturing operations use as many as fifteen or twenty of these coils per day. Typically, a production/processing line has to be shut down as the supply of material from one coil is exhausted either to rethread a fresh coil of material or to weld the lead end of the fresh coil to the trailing end of the depleted coil. Welding coils together can be difficult because of the need to properly align the coil ends. Often specialized equipment is required to do this. U.S. Pat. No. 3,338,498 to Nelson for example illustrates a multi-coil feed system for supplying material to a metal processing line. The system includes a device for aligning the ends of coils to be welded together.

The downtime associated with rethreading and/or material welding can severely impact the productivity of a metals operation. Further productivity losses occur as a result of a loss in operator time during the replacement of spent coils. Attempts to increase productivity have centered about providing very long coils which will permit automatic operation of equipment for long periods of time without rethreading and/or welding. One attempt in the prior art to solve the problem of productivity losses has involved the provision of a traverse wound coil comprised of a strip of material wound upon a spool in the manner of line wound upon a fishing reel. It has been hoped that a continuous supply of material equal to several of the usual flat coils could be provided for continuous feed to a machine using this approach. While this arrangement is satisfactory for some materials, such as rods, strings, wire or the like, it has not proven satisfactory for use with flat strip materials because they tend to become caught or overlapped, thus stopping feed of the material and interrupting production. For example, side camber or a loss of straightness when changing direction can interfere with the feed of material.

Recent improvements in techniques for joining flat packs together have lead to the development of a number of continuous metal feed systems. For example, U.S. Pat. No. 4,022,396 to Manchester et al. describes a system for paying of a plurality of interconnected coils. In the Manchester et al. system, the coils are stacked in coaxial relationship one upon another on a rotatable payoff stand and joined together. The interconnection between the coils may be a joining of the outer wraps of the coils, the inner wraps of the coils, the outermost wrap of one coil to the innermost wrap of the adjacent coil, or a combination of the foregoing. The interconnected coils are separated either by a thin sheet of friction material, e.g. rubber or paper, or a number of strips of friction material to prevent lateral slippage therebetween. Since the separating devices are intended to have some frictional relationship with the coils, it is not clear how easily they can be removed from the top surface of a coil after the coil above it has been depleted. The presence of these separating devices could interfere with the feed of the strip material. Further, these separating devices, if permitted to rest on the coils as they unwrap, could damage at least the edges of the unwrapping strip material.

The article "New System Provides Continuous Coil Without Accumulators", *Fabricator*, May/June 1986 illustrates another continuous feed system. In this system, a plurality of coils are stacked on a coil/horn assembly which is then mounted to a driven uncoiler. Adjacent coils are separated by a series of separator disk assemblies having an apparent semi-circular configuration. The coils are interconnected by welding the outermost wrap of one coil to the innermost wrap of the adjacent coil. A number of retaining blocks are used to properly position the wraps after welding. This system is much more complex than systems such as Manchester et al.'s. It requires a special indexing and takeoff stand to insure proper unwrapping of the stacked coils. Further, to insure that the separator assemblies do not interfere with the feed of material, only half of each coil is actually supported. This obviously places severe restrictions on the size of the coils which can be accommodated. In this regard, it should be noted that the upper coils in the pictures accompanying the article are smaller than the lower coils.

With the present invention, many of the problems associated with the prior art feed systems are avoided. The continuous strip feed device of the present invention has a central member adapted to receive a plurality of coils or flat packs of strip material which can later be interconnected. The central member is capable of rotation about its longitudinal axis and has a plurality of longitudinally extending grooves for accommodating a plurality of retractable spacing elements in a number of positions. The retractable spacing elements each have a first portion shaped to register with the longitudinally extending grooves and a second rotatable portion for supporting and separating adjacent coils. The provision of retractable spacing elements is quite desirable from the standpoint of promoting uninterrupted and continuous feed of the strip material. It also reduces the likelihood of damaging the strip material as it is fed to the production or processing line. The provision of a rotatable central member is desirable from the standpoint of permitting coils to unwrap at a substantially constant speed interms of linear feet per minute. Further advantages of the present invention include the ability to accommodate flat packs having a wide range of thicknesses and the ability to stack a sufficient number of coils to supply material for prolonged periods of time.

Accordingly, it is an object of the present invention to provide a device for supplying in a continuous and uninterrupted manner extra-long lengths of strip material to a machine during a manufacturing process or the like.

It is a further object of the present invention to provide a device as above capable of handling a wide range of continuous strip materials.

It is yet a further object of the present invention to provide a device as above capable of increasing productivity by reducing machine downtime.

These and other objects and advantages will become more apparent from the following description and drawings in which like numerals depict like elements.

Figure 1:
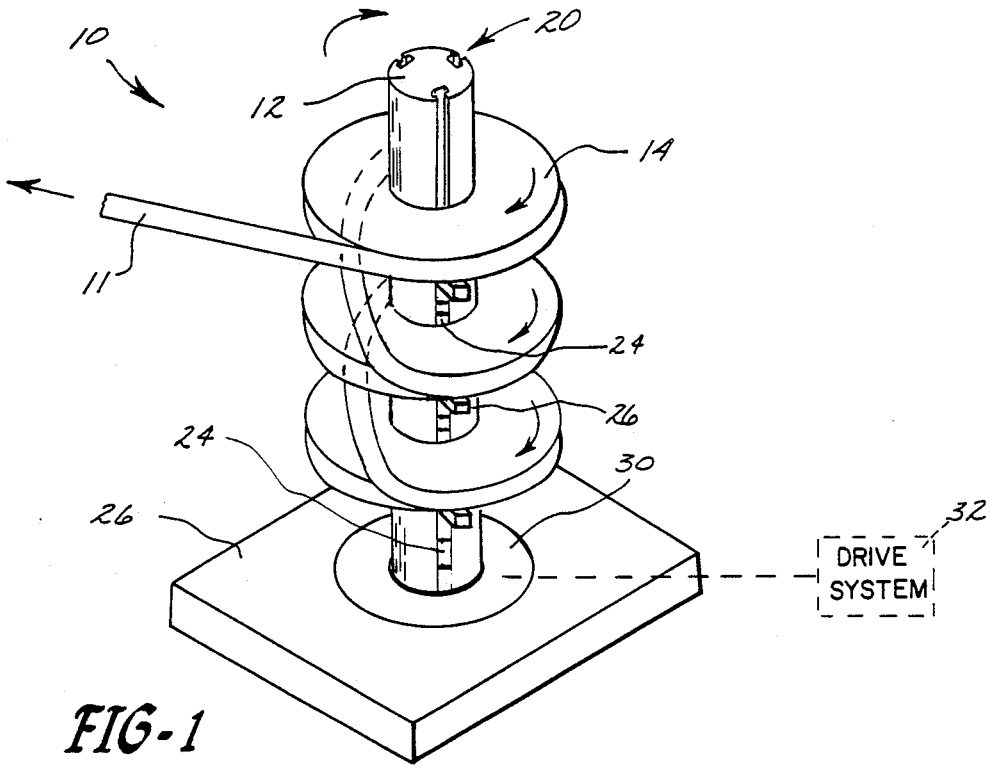
FIG. 1 is a perspective view of the material feed device of the present invention.
Figure 3:
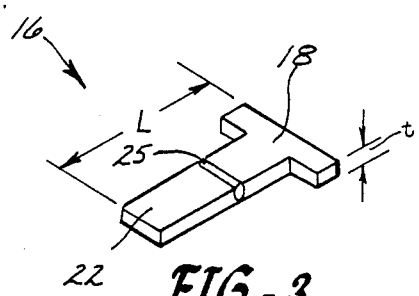
FIG. 3 is a perspective view of one of the coil spacing elements of the device.

The continuous strip material feed device of the present invention may be used in conjunction with a variety of metal fabricating or processing operations. For example, it may be used as part of a coil-fed stamping line, an electrolytic tinning line, a roll forming line or other metal processing/fabricating operations.

Referring now to the Figures, the device 10 has a central member 12 upon which a plurality of coils 14 of strip material 11 may be stacked. Each coil of course may comprise a plurality of wraps of any desired strip material and may have any desired size and thickness T. Typically, slit metal or metal alloy strip materials have a thickness on the order of about 1 inch. The central member 12 may have any desired configuration although it is preferred that it be substantially cylindrical to facilitate loading of the coils. The outer dimension of the central member should be sufficiently smaller than the inner diameter of the coils 14 to permit the outer wrap of a stacked coil to be joined to the inner wrap of an adjacent coil. The central member 12 may have any desired length.

In accordance with the present invention, the central member 12 is provided with a plurality of longitudinally extending grooves 20 circumferentially spaced about its periphery. For reasons relating to the stability of and the provision of adequate support for the coils, it is preferred that the grooves 20 be spaced equidistant from each other. While the central member 12 may have any number of longitudinally extending grooves, ordinarily three such grooves will be sufficient.

The device 10 further comprises a plurality of spacing elements 16 for separating adjacent ones of the coils 14. The spacing elements 16 each have a first portion 18 for engaging one of the longitudinally extending grooves 20 in the central member and a second portion 22 for contacting and separating adjacent coils 14. The first portion 18 of each spacing element may be formed from any suitable material, preferably from steel or some other metal or metal alloy. Metallic materials are preferred for the portion 18 because they add strength to the overall structure and are less likely to be damaged during insertion into the grooves. Although the second portion 22 could also be formed from a metallic material, it is preferred that it be formed from a non-metallic material such as plastic. By using a non-metallic material for the portion 22, one can minimize the frictional effects between its coil contacting surface(s) 28 and the coil and thereby reduce the potential for damaging the strip material.

The first portion 18 of each spacing element is provided with a shape corresponding to that of the grooves 20. This is to permit registration between each element and a respective one of the grooves as well as to provide a means for locking the spacing elements in place along an axis parallel to the plane of the coil or flat pack. While the grooves 20 and the first portions 18 may have any number of shapes, it is preferred that the grooves 20 comprise longitudinally extending T-shaped slots and the portions 18 have a corresponding T-shape. The spacing elements 16 may be positioned in a desired location along the length of a groove by inserting the T-shaped portion 18 into the T-shaped groove and sliding it to a desired position. Each groove 20 may be provided with a series of stops 24 upon which the spacing elements may rest.

Figure 2:
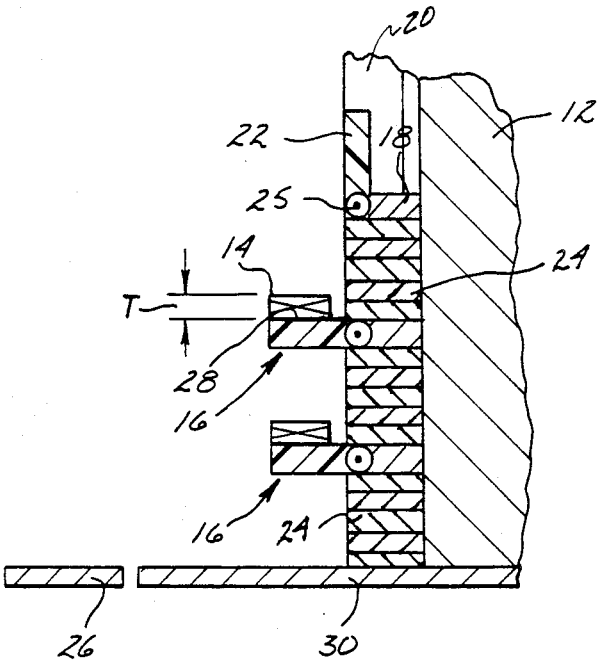
FIG. 2 is an exploded view in partial cross section of the device of the present invention.

The second portion 22 of each spacing element is preferably designed to be rotatable or pivotable with respect to the first portion 18 to enable it to be moved from a coil contacting position to a retracted position (see FIG. 2). By providing such an arrangement, the risk of the second coil contacting portion 22 interfering with the unwrapping and continuous feed of the strip material can be reduced. Suitable means 25 for permitting the portion 22 to rotate relative to the portion 18 may be provided. Such means may comprise any suitable hinge known in the art including a spring hinge. Retraction of the spacing elements can be done manually or automatically through the use of an appropriate spring hinge. Of course, if a spring hinge is used, it should not interfere with the unwrapping of the coil.

While the spacing elements 16 may have any desired length L, it is preferred that the second portion 22 extend to the outermost wrap of the coil to prevent telescoping. With respect to the thickness t of the elements 16, it is preferred that it be greater than the thickness T of the coil. This is desirable from the standpoint of insuring the absence of any interference between the spacer elements and the strip material as it unwraps.

The central member 12 may be mounted to a supporting structure 26 in any desired manner. For example, the central member may have a base portion 30 which fits into the support structure. The base portion 30 may be an integral part of the central member or it may be an attachment to the central member. Preferably, the central member 12 and its base 30 are mounted to the support structure in a way which permits the central member to rotate freely about its longitudinal axis so that a substantially constant payoff speed in terms of linear feet/minute can be maintained. Any suitable freewheeling, substantially frictionless bearing system known in the art may be used to mount the central member 12 and its base 30 to the supporting structure 26. If desired, the central member could be driven through an appropriate drive system 32 such as a motor-pulley system. For most applications however this is not desirable since rotational velocity will vary with coil radius during the unwinding process. The central member 12, the base 30 and the supporting structure 26 may be formed from any desired material Generally, metallic materials will be used for these structures.

After the coils 14 have been loaded on the central member 12, they may be interconnected in any desired manner. Preferably, they are joined so that the inner wrap of the top coil of a pair of coils is joined without rotation to the outer wrap of the immediately lower coil. By joining the coils in this manner, continuous payoff will occur when the central member is rotated. Any suitable splicing technique known in the art such as one of those shown in U.S. Pat. Nos. 3,106,013 to Rozmus, 3,847,323 to Good et al. and 4,022,396 to Manchester et al., which are all hereby incorporated by reference herein, may be used to join the coil wraps together.

In accordance with the present invention, a supply of continuous strip material may be prepared as follows. A first coil 14 is placed onto the central member 12. A plurality of spacing elements 16 separated by a plurality of stops 24 are then loaded into the grooves 20 and slid along the grooves to a desire location where either the undersurface of each spacing element is in contact with the first coil or spaced a desired distance from the first coil. Positioning of the spacers is accomplished by use of stops 24. After the first set of spacing elements have been positioned, a second coil 14 is placed onto the central member and moved into contact with the spacing elements. The sequence is continued until a desired number of coils or flat packs have been stacked. One of the advantages of the present invention is that a fairly large number of flat packs can be stacked on the central member. After stacking has been completed, the coils may be interconnected in the manner described above. If desired, the coils may be spliced together as they are loaded. To unwrap the strip material from the stacked coils, an appropriate means for applying a tension force to the material not shown such as a take-up reel is connected to the lead end of the lead coil. The relatively free rotation of the central member will insure that the material is unwrapped in an uninterrupted and continuous manner.

In addition to the advantages previously discussed, the central member 12 with the stacked, interconnected and separated coils 14 may be placed on a pallet not shown and then prepared for shipping to a desired location if desired. To facilitate shipping, the central member may be designed to be separable from its base 30 and/or the supporting structure 26. Alternatively, the entire device 10 may be placed on a pallet and prepared for shipment.

As previously discussed, one of the main advantages of the present invention is the ability of the device 10 to accommodate coils or flat packs having a wide range of thicknesses. The presence of adjustable spacing elements makes this possible.

While the present invention has been described in terms of feeding metal or metal alloy strip material to a metal fabrication/processing line, it should of course be apparent that the device of the present invention may be used to supply other types of strip material. Similarly, it may be used to supply materials in other forms such as in rod form, wire form or the like.

While it is preferred that the spacing elements 16 be adjustable, the device 10 can be constructed with a series of spacing elements in predetermined and fixed locations. When such a construction is used, the spacing elements 16 should be designed so that the coil contacting portions 22 are completely retractable within the grooves 20 so as not to interfere with the loading as well as the unwrapping of the coils.

While it is preferred that the rotatable portion 22 of the spacing elements completely retract into the grooves 20, it is not necessary for them to do so. The retractable portions 22 as a result of a particular coil spacing may contact a portion of an adjacent retracted spacing element and thus be prevented from completely retracting into the groove. This is not a problem since the portion 22 even in such a partially retracted position will not interfere with the unwrapping an continuous feed of the coil material.

The patents and article set forth in the specification are intended to be incorporated by reference herein.

It is apparent that there has been provided in accordance with this invention a long-length continuous metal strip feed device which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A device for supplying extra-long lengths of continuous strip material, comprising:

a rotatable central member having a first diameter and a plurality of longitudinally extending grooves spaced around its periphery;

said material being supplied as a plurality of coils having a given thickness and an inside diameter, said inside diameter being greater than the first diameter of said central member, said coils being stacked upon said central member, each said coil being interconnected to adjacent coils such that an outermost wrap of a coil is joined to the innermost wrap of an adjacent coil;

a plurality of spacing elements disposed between adjacent coils, said spacing elements having a first portion for allowing relative movement connecting means disposed therebetween, said first portion having a shape corresponding to the shape of said grooves of said central member each said first portion of said spacing elements being received in one of said grooves, said second portions extending radially outward from said grooves to contact and support at least one of said coils; and at least one stop disposed between each of said adjacent spacing element for maintaining a desired distance between adjacent spacing elements.

2. The device of claim 1 wherein:

said connecting means is disposed between said first and second portion of said spacing element providing for said second portion being rotatable relative to said first portion.

3. The device of claim 2 wherein:

said first and second portions is formed from dissimilar materials.

4. The device of claim 3 wherein:

said first portion is formed from a metal or metal alloy; and said second portion is formed from a non-metallic material.

5. The device of claim 2 wherein:

each said groove comprises a longitudinally extending T-shaped slot.

6. The device of claim 5 wherein:

said first portion of each said spacing element is T-shaped to permit registration with one of said slots.

7. The device of claim 2 wherein:

each said spacing element is capable of sliding along the length of said groove to facilitate the accommodation of different sized coils of material.

8. The device of claim 2 wherein:

said grooves are equally spaced about the periphery of the central member.

9. The device of claim 2 wherein:

said central member has a base portion; and said base portion being mounted for rotation within a supporting structure.

10. The device of claim 9 further comprising:

means for rotating said central member at a desired speed.

11. The device of claim 2, wherein said connecting means comprises a spring hinge for resiliently biasing the first and second portion of the spacing element relative to each other.

* * * * *

UNITED STATES PATENT AND TRADEMARK OFFICE

CERTIFICATE OF CORRECTION

PATENT NO. : 4,844,360

DATED : July 4, 1989

INVENTOR(S) : JOSEPH WINTER

It is certified that error appears in the above—identified patent and that said Letters Patent is hereby corrected as shown below:

Column 6, line 29, between "portion" and "for allowing" please insert ---and a second portion with a connecting means---.

Column 6, line 29, between "movement" and "disposed" please delete [connecting means].

Column 6, line 39, please delete "element" and insert ---elements--- in its place.

Column 8, line 2, please delete "portion" and insert ----portions--- in its place.

Signed and Sealed this

Fifth Day of May, 1992

*Attest:*

DOUGLAS B. COMER

*Attesting Officer*

*Acting Commissioner of Patents and Trademarks*